US007166004B2

(12) United States Patent
Wilson

(10) Patent No.: US 7,166,004 B2
(45) Date of Patent: Jan. 23, 2007

(54) SWIMMING AID

(76) Inventor: Giles Wilson, 6/214 Marine Parade, Kingscliff, NSW (AU) 2487

( * ) Notice: Subject to any disclaimer, the term of this patent is extended or adjusted under 35 U.S.C. 154(b) by 0 days.

(21) Appl. No.: 10/525,851

(22) PCT Filed: Aug. 26, 2003

(86) PCT No.: PCT/AU03/01086

§ 371 (c)(1),
(2), (4) Date: Sep. 16, 2005

(87) PCT Pub. No.: WO2004/018052

PCT Pub. Date: Mar. 4, 2004

(65) Prior Publication Data

US 2006/0089066 A1 Apr. 27, 2006

(30) Foreign Application Priority Data

Aug. 26, 2002 (AU) ..... 2002950995

(51) Int. Cl.
*A63B 31/08* (2006.01)

(52) U.S. Cl. ..... 441/64; D21/806

(58) Field of Classification Search ..... 441/61, 441/64; D21/806
See application file for complete search history.

(56) References Cited

U.S. PATENT DOCUMENTS

| | | | | |
|---|---|---|---|---|
| 2,729,832 | A * | 1/1956 | Schmitz | 441/64 |
| 4,310,938 | A | 1/1982 | Eichler | |
| 4,787,871 | A * | 11/1988 | Tomlinson | 441/61 |
| 4,948,385 | A | 8/1990 | Hall | |
| 5,108,328 | A | 4/1992 | Hull | |
| 2003/0148855 | A1 | 8/2003 | Ryland | |

FOREIGN PATENT DOCUMENTS

| | | |
|---|---|---|
| DE | 460511 | 5/1928 |
| SU | 1227213 | 4/1986 |

* cited by examiner

*Primary Examiner*—Jesus D. Sotelo
(74) *Attorney, Agent, or Firm*—Thorp Reed & Armstrong, LLP

(57) ABSTRACT

A swimming aid (10) including a body portion (11), upon which is situated a locating means (12) for the foot of the wearer. The swimming aid (10) also includes a lobular flexible web (13) and at least two ribs (14), each of which contain a plurality of segments (15). The segments of each rib cooperating to stiffen said flexible web against flexion substantially above the plane of said body portion.

17 Claims, 3 Drawing Sheets

SWIMMING AID

FIELD OF THE INVENTION

This invention relates to a swimming aid. More specifically this invention relates to a breast stroke swimming aid designed to enhance the power phase of the breast stroke kick to improve speed, and the invention will be described hereinafter with reference to this application. However, it is envisaged that this invention will find other application such as in leg strength and stamina training, physiotherapy and rehabilitation, and in other swimming forms utilizing a "round leg" kick in the manner of a breaststroke kick.

BACKGROUND TO THE INVENTION

Of the four common "strokes" used in swimming, being freestyle, backstroke, butterfly and breast stroke, all except breaststroke utilize a dorsal/ventral kicking action where the legs each move substantially in a plane of normal bipedal ambulation. A number of recreational and training aids exist for use with all of the dorsal/ventral-kick strokes including kick boards and hand fins, and swimming foot fins which can be utilised for freestyle, backstroke and butterfly. The style of fin applicable to one of these strokes is easily applied to another, furthermore the same style of fin can be used for scuba diving, snorkelling, boogie boarding, body surfing and fin racing. The common style of fin used in these strokes and sports can be termed a "vertical fin" due to its suitability for use where the stroke uses a dorsal/ventral kicking action. However, due to the distinct differences between the kick mechanics of freestyle, backstroke and butterfly on the one hand and breast stroke on the other it is generally inappropriate to apply a vertical fin to breast stroke.

The use of fins during swimming training has many benefits; it can improve kick strength through increased resistance, increase ankle flexibility thus allowing better angles with which to attack the water during the propulsive phase, and improve body position in the water. Additionally it allows the swimmer to focus on other aspects of their stroke. All of these aid in the development of improved kick strength and stroke technique. Furthermore, because fins allow the maintenance of higher speeds for longer periods of time they allow the swimmer and to increase overall muscle strength and endurance, cardiovascular fitness and flexibility.

Generally the swimming style utilised by a swimmer at race pace is different to that at lower speeds. Athletes aim for "motor memory", by which the desired style/technique is learnt at a muscular level. This means that as the swimmer tires, they can maintain these technical principles longer. Small fins allow the swimmer to reach race pace speeds without the same amount of exertion and also without altering their normal kicking style, thus allowing the swimmer to concentrate on arm stroke technique at high speeds. Similarly if the swimmer has an upper body injury, by using fins he/she will benefit from still being able to train at race speed with less strain being placed on the upper body in order to maintain that pace.

Russian Inventor's Certificate SU 1227213 discloses a breaststroke swimming aid having a body portion including a foot pocket and an integrally formed lateral resilient web extending laterally of the foot. The essence of this apparatus is to increase the effective area of the sole of the foot in order that an increased muscular effort may be converted to propulsive force on the power stroke of the kick. However, the apparatus similarly, imposes an increased area opposing the return stroke, which operates counter to the low resistance return stroke of the unaided breaststroker, forcing an exaggerated action to feather the web.

German Patent Specification DE 460511 describes a breaststroke swimming aid having a foot supporting body having hinged, rigid flaps extending laterally and inward of the sole of the user. The flaps are adapted to fold under water resistance along the hinge lines to reduce drag on the return stroke and to deploy to blocked, respectively lateral and inward extended positions on the power stroke to increase the effective area of the sole of the foot in order that an increased muscular effort may be converted to propulsive force. This construction has the disadvantages of interference between the respective inward flaps on the left and right feet of the user at the end of the power stroke. The disposition of a flap to the inner side of the foot also tends to cause eversion of the foot of the user in the power stroke. The hinged and blocked arrangement is not progressive and shock-loads the user's ankles early in the power stroke.

SUMMARY OF THE INVENTION

According to one aspect of this invention there is provided a breaststroke swimming aid including:

a body portion;

locating means for the foot of the user located on top of said body portion;

a flexible web extending laterally from said body portion; and at least two segmented ribs disposed on said flexible web and extending laterally from said body portion towards the edge of said flexible web, the segments of each said rib cooperating to stiffen said flexible web against flexion substantially above the plane of said body portion.

The body portion may be made of any appropriate material including natural or synthetic rubber, leather or polymer material. The body portion may be formed integrally with the web or apart from it in assembly.

The locating means for the foot may be orientated directly on the body portion, or alternatively it may be orientated slightly above or below the body portion. Preferably said locating means is made of a flexible material to allow for comfortable fitting of the foot and/or to allow free range of movement for the ankle. Alternatively the locating means may be relatively rigid but open at the ankle, and may in this case be associated with securing means adapted to retain the foot in the locating means while allowing relatively free articulation of the ankle. An example of an appropriate material is again natural or synthetic rubber, leather or polymer material. The locating means may be formed integrally with the body portion.

The locating means for the foot may either totally enclose or partially cover the foot. Alternatively it may be a series of one or more straps which hold the foot in place. The locating means may only partially enclose the foot such that at least one or both of the toes and heel are not covered. In embodiments where the locating means for the foot is open toed the web may extend beneath or even forward of the toes of the user. The configuration of the web may be selected having regard to positioning the centre of effort in a desired position. It is envisaged that for larger main webs it may be desirable to vary or balance the net centre of effort by the provision of at least one relatively smaller tuning web. For example the tuning web or webs may be positioned at one or more of the toes or on the inner side of the foot at the arch or heel.

The flexible web may be of any shape extending laterally from the said body portion. The web may be generally semicircular. However, in order that the forces involved resolve themselves to load the foot at the natural load points of the heel and ball of the foot, the web may be lobular in form. For example the web may have a certain lateral extent at the heel region, a different extent at the ball region and a minimum extent at the intermediate region, or arch of the foot. Alternatively the lateral extent at the heel and ball regions may be equal with a minimum extent at the intermediate region. The absolute extent and the relative extent at these three regions may be determined empirically based on the selected resistance and balance required by the user.

The flexible web may be formed integrally with the locating means and/or the body portion. The flexible web may be made of any flexible material, again for example natural or synthetic rubber, leather or polymer material.

Each of the at least two segmented ribs are disposed upon the said flexible web and extend laterally from the body portion towards the edge of the flexible web. In one embodiment the ribs extend both laterally and divergently from the body portion.

Preferably the segmented ribs contain at least two segments, the number of segments being proportional to the length of the rib such that the longer the rib the greater the number of segments.

The segmentation of the ribs may take numerous forms. The segments may be formed simply by cutting into the rib itself thereby separating the segments of the rib or a small section may be cut out between the segments; in such embodiments the segments may be interconnected by the material of the web. Alternatively the rib may be composed of originally separate segments which are linked together to allow co-operation to stiffen. Appropriate linking means include a hinge.

In certain embodiments the rib may be segmented by cuts in the rib itself, with the web conjoing the segments. These cuts may be angled with respect to the top of the rib to better facilitate co-operation between the segments to stiffen the flexible web against flexion substantially above the plane of the body portion.

DETAILED DESCRIPTION OF THE PREFERRED EMBODIMENT

It will be convenient to hereinafter provide a detailed description of one embodiment of the invention with reference to the accompanying drawings. The purpose of providing this detailed description is to instruct persons having an interest in the subject matter of the invention how to put the invention into practice. It is to be clearly understood however that the specific nature of this detailed description does not supersede the generality of the preceding statements.

Figure 1:
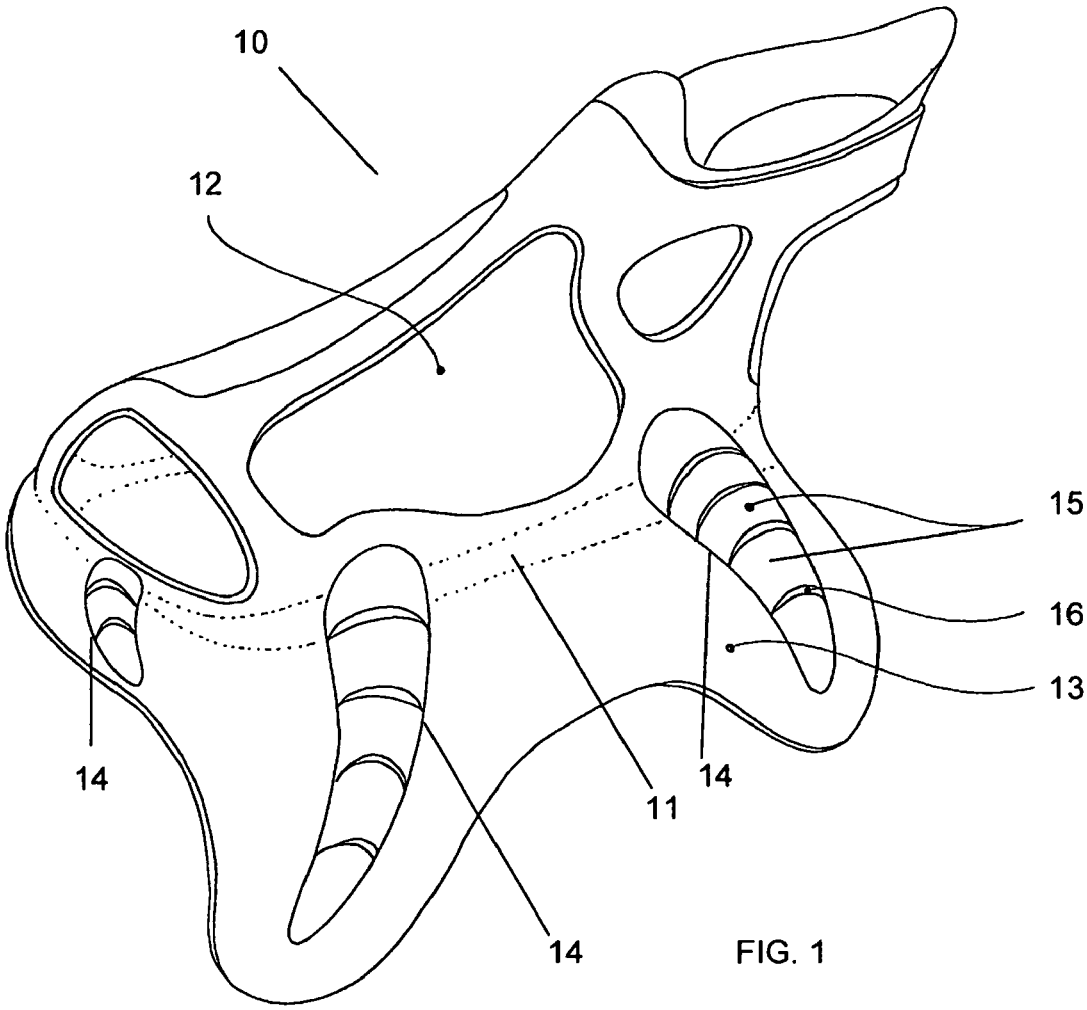
FIG. 1 is a perspective view of the front and lateral sides of the breast stroke swimming aid in its resting orientation, which is also the proposed moulding position for a single moulded material.

The detailed description below describes the invention.

In the drawings reference 10 generally indicates a breast stroke swimming aid within the scope of the current invention. The swimming aid depicted in the figures (10) includes a body portion (11), upon which is situated a locating means (12) for the foot of the wearer. The swimming aid (10) also includes a lobular flexible web (13) and three ribs (14), each of which contain a plurality of segments (15). Each pair of segments is separated by a cut (16) in the rib itself.

Figure 4:
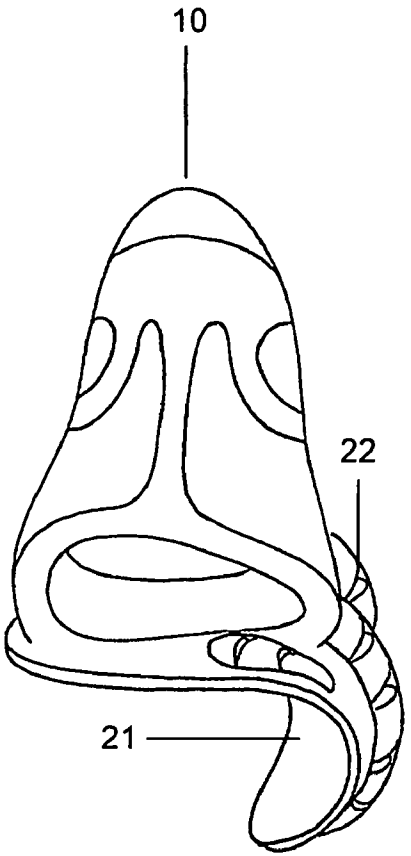
FIG. 4 is a front view of the breast stroke swimming aid in the orientation it assumes in the return phase of the breast stroke kick.
Figure 3:
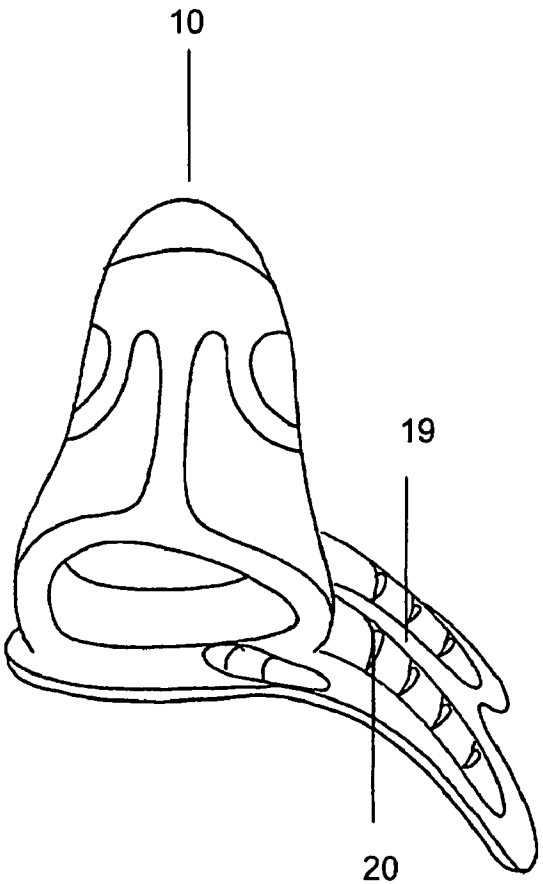
FIG. 3 is a front view of the breast stroke swimming aid in its resting orientation, which is also the proposed moulding position for a single moulded material.
Figure 2:
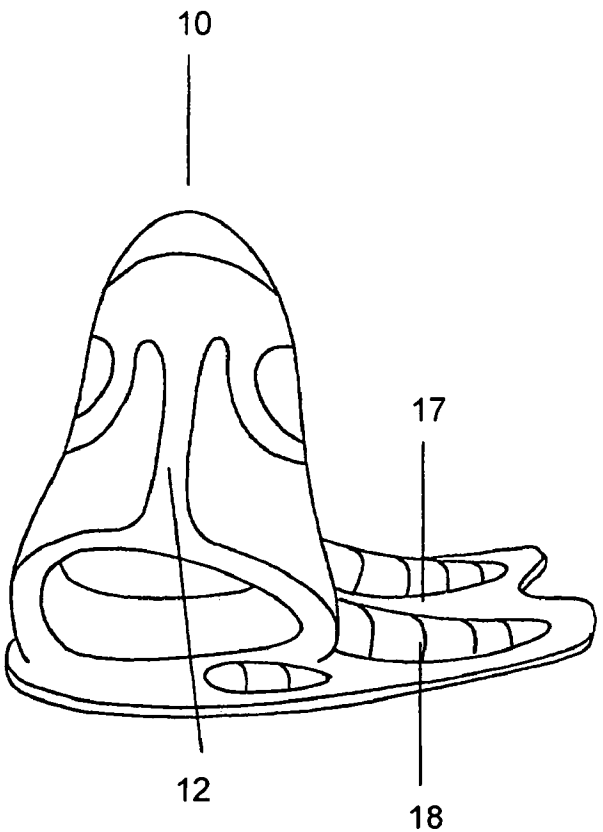
FIG. 2 is a front view of the breast stroke swimming aid in the orientation it assumes in the power phase of the breast stroke kick.
Figure 5:
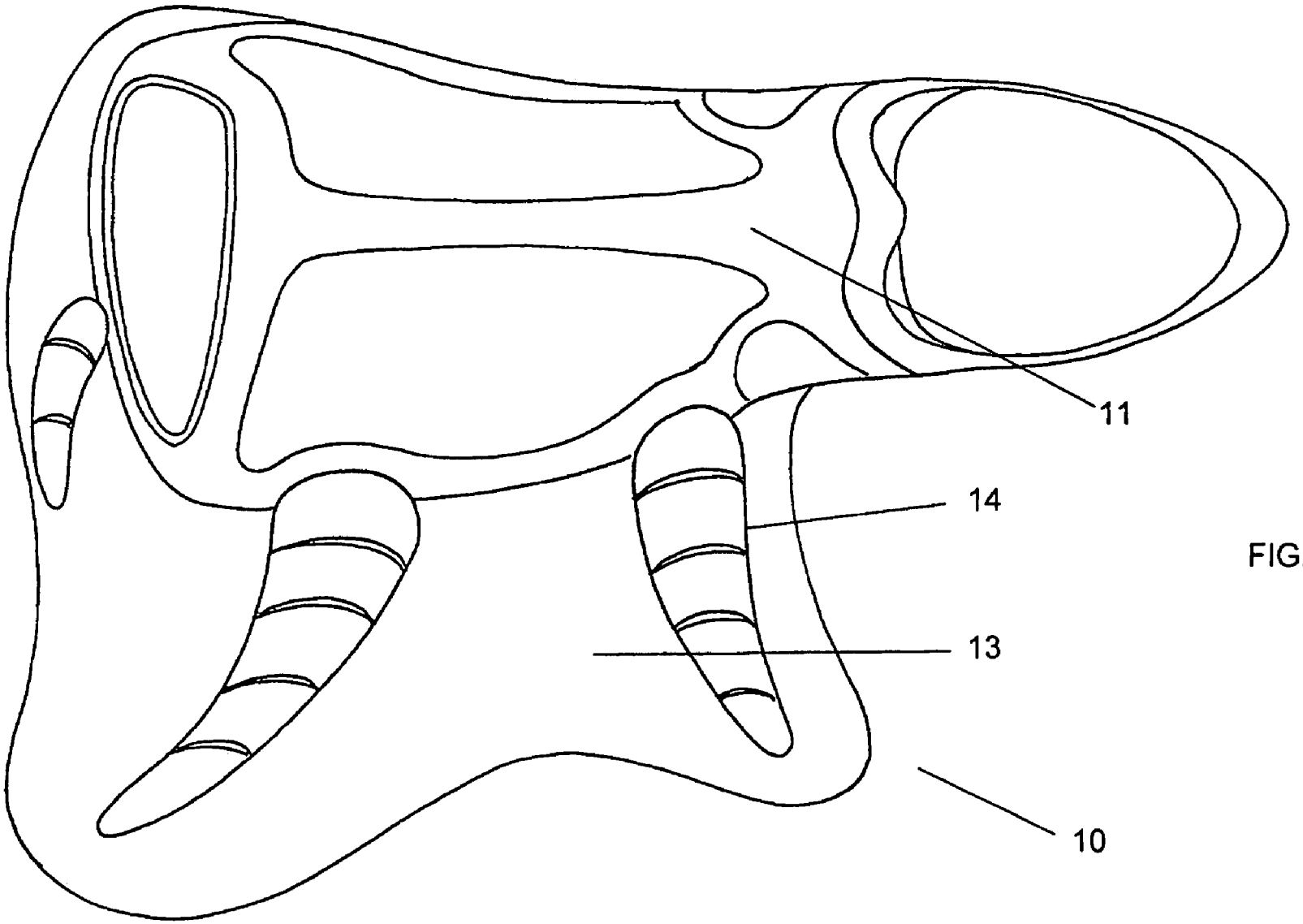
FIG. 5 is the top view of the breast stroke swimming aid in its resting orientation, which is also the proposed moulding position for a single moulded material.

FIGS. 2–4 display the range of movement which is allowed for by the design of the segmented ribs. As the swimmer is working through the power phase of the kick the leg and foot are thrust away from the body and through the force of the water. The force of the water pushed against the underside of the fin encouraging it to bend back towards outside of the swimmers ankle. The gaps between the segments are then closed (18) and the segments are forced together. This co-operation of the segments results in stiffening of the flexible web (17) against flexion substantially above the plane of the body portion.

In its resting orientation (FIG. 3) there is no upward resistance on the fin and the segments separate to the unforced extent allowed by the cuts in the ribs (20). As such the flexible web will bend to a degree determined by the size of the separating means.

During the return phase of the kick the swimmers legs and feet are brought back up towards the body. As a result the force of the water is on the upper side of the fin. If there was no means of the fin to fold away from the orientation it takes during the power phase (see FIG. 2) the resistance on the fin caused by the water would increase the force against the fin, resulting in more exertion being required to execute the return phase of the kick.

The segmented ribs on the flexible fin of the current invention allow the fin to curve towards the underside of the foot, thereby decreasing the water resistance on the fin. As the water force is applied to the upper side of the fin the cuts in the ribs separate (22) to facilitate curving of the ribs and thus curving of the flexible web (21).

This invention relates particularly but not exclusively to use of the fin by athlete's during training to facilitate the maintenance of higher swim speeds over a longer period of time and it will be convenient to hereinafter describe the invention with reference to this example application. However it is to be clearly understood that the invention extends to all facets of swimming including recreational use, and situations where swim speed may not actually be increased by use of the fin such as when learning to swim, maintenance of regular fitness and/or use in rehabilitation from injury.

It will of course be realised that the above has been given only by way of illustrative example of the invention and that all such modifications and variations thereto as would be apparent to persons skilled in the art are deemed to fall within the broad scope and ambit of the invention as herein set forth.

In the specification and claims the term "comprising" shall be understood to have a broad meaning similar to the term "including" and will be understood to imply the inclusion of a stated integer or step or group of integers or steps but not the exclusion of any other integer or step or group of integers or steps. This definition also applies to variations on the term "comprising" such as "comprise" and "comprises".

The claims defining the invention are as follows:

1. A swimming aid comprising:

a body portion;

locating means for the foot of a user located on top of said body portion;

a flexible web extending laterally from said body portion; and at least two segmented ribs disposed on said flexible web and said ribs extending laterally and divergently from said body portion towards the edge of said flexible web, the segments of each of said ribs cooperating to stiffen said flexible web against flexion substantially above the plane of said body portion.

2. The swimming aid according to claim 1, wherein said locating means fully encloses the user's foot.

3. The swimming aid according to claim 1, wherein said locating means is partially open at the toes of the user's foot.

4. The swimming aid according to claim 1, wherein said flexible web comprises a ball region, a heel region and an intermediate region of lesser lateral extent than said ball and heel regions.

5. The swimming aid according to claim 4, wherein said ball region is of greater lateral extent than said heel region.

6. The swimming aid according to claim 1, additionally comprising tuning webs disposed at at least one of a toe region and an arch region of said body portion.

7. The swimming aid according to claim 6, wherein said flexible web includes at least one tuning web composed of a segmented rib disposed thereon.

8. The swimming aid according to claim 1 or claim 7, wherein said segmented ribs are segmented by cuts or excisions and are hingedly interconnected by the material of the flexible web.

9. The swimming aid according to claim 1 or claim 7, wherein said segmented ribs include individual segments linked via a flexible linking means.

10. The swimming aid according to claim 9, wherein the linking means is in each case a hinge.

11. The swimming aid according to claim 1 or claim 8, wherein said each segment of said segmented ribs segments block together to provide said stiffening of the web.

12. The swimming aid according to claim 6, wherein at least one of said flexible web and said tuning webs are formed integrally with said locating means and said body portion.

13. The swimming aid according to claim 1, wherein at least one of said locating means and said flexible web comprises a material selected from the group including natural or synthetic rubber, leather or polymer material.

14. The swimming aid according to claim 1, wherein said locating means is partially open at the heel of the user's foot.

15. The swimming aid according to claim 1, wherein said locating means is partially open at the toes and heel of the user's foot.

16. The swimming aid according to claim 1, additionally comprising tuning webs disposed at the toe and an arch region of said body portion.

17. The swimming aid according to claim 16, wherein said tuning webs each include a segmented rib disposed thereon.

* * * * *